US008210668B2

(12) United States Patent
Espinoza-Ibarra et al.

(10) Patent No.: US 8,210,668 B2
(45) Date of Patent: Jul. 3, 2012

(54) CONTAINER

(75) Inventors: Ricardo Espinoza-Ibarra, San Diego, CA (US); James Hasler, San Diego, CA (US); Ben Percer, Murrieta, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 689 days.

(21) Appl. No.: 12/352,389

(22) Filed: Jan. 12, 2009

(65) Prior Publication Data

US 2010/0177149 A1 Jul. 15, 2010

(51) Int. Cl.
*B41J 2/175* (2006.01)
*B41J 2/195* (2006.01)

(52) U.S. Cl. ..... 347/86; 347/7

(58) Field of Classification Search ..... 347/6, 7, 347/9, 47, 85–87

See application file for complete search history.

(56) References Cited

U.S. PATENT DOCUMENTS

| | | | | |
|---|---|---|---|---|
| 4,350,458 | A | 9/1982 | Murahara | |
| 4,604,633 | A | 8/1986 | Kimura | |
| 5,328,727 | A | 7/1994 | Kashio | |
| 5,903,401 | A | 5/1999 | Tanaka | |
| 6,024,441 | A | 2/2000 | Nishimoto | |
| 6,422,675 | B1 * | 7/2002 | Tomomatsu | 347/7 |
| 6,523,920 | B2 | 2/2003 | Wade | |
| 6,592,039 | B1 | 7/2003 | Smith | |
| 6,609,792 | B2 | 8/2003 | Kaga | |
| 6,747,684 | B2 | 6/2004 | Ornellas | |
| 6,905,187 | B2 | 6/2005 | Arquilevich | |
| 6,984,013 | B2 | 1/2006 | Arquilevich | |
| 7,029,083 | B2 * | 4/2006 | Merz et al. | 347/7 |
| 2002/0135788 | A1 | 9/2002 | Arakawa | |
| 2004/0265041 | A1 | 12/2004 | Miyamoto | |
| 2006/0182937 | A1 | 8/2006 | Tsuchimura | |
| 2006/0244790 | A1 | 11/2006 | Umeda | |
| 2007/0115314 | A1 * | 5/2007 | Kondo et al. | 347/19 |

FOREIGN PATENT DOCUMENTS

| | | | |
|---|---|---|---|
| DE | 3442583 | A1 | 5/1986 |
| EP | 1450093 | A1 | 8/2004 |
| EP | 1688466 | A1 | 8/2006 |

OTHER PUBLICATIONS

PCT Search Report for International Application No. PCT/US2007/081315, filing date Oct. 12, 2007.

* cited by examiner

*Primary Examiner* — Geoffrey Mruk

(57) ABSTRACT

A fluid container includes a body having an inlet configured to receive a fluid, a printhead configured to eject the fluid received at the inlet, and an optical receiver at the body and positioned in optical communication with the inlet such that optical signals received at the inlet are received at the optical receiver.

10 Claims, 8 Drawing Sheets

CONTAINER

BACKGROUND

In inkjet printing, it is common for electronic control signals to be transmitted from control circuitry in the printing device through electrically conductive conduits to electronic components at containers that hold printing fluid. The control signals may affect the operation of the containers, such as when ink is released from the containers onto print media. Wires or cables are generally used to electrically connect the control circuitry to the related components in the fluid container. Use of such wires or cables may be expensive, cumbersome, or both.

BRIEF DESCRIPTION OF THE DRAWINGS

Throughout the drawings, identical reference numbers designate similar, but not necessarily identical, elements.

DETAILED DESCRIPTION

Figure 1:
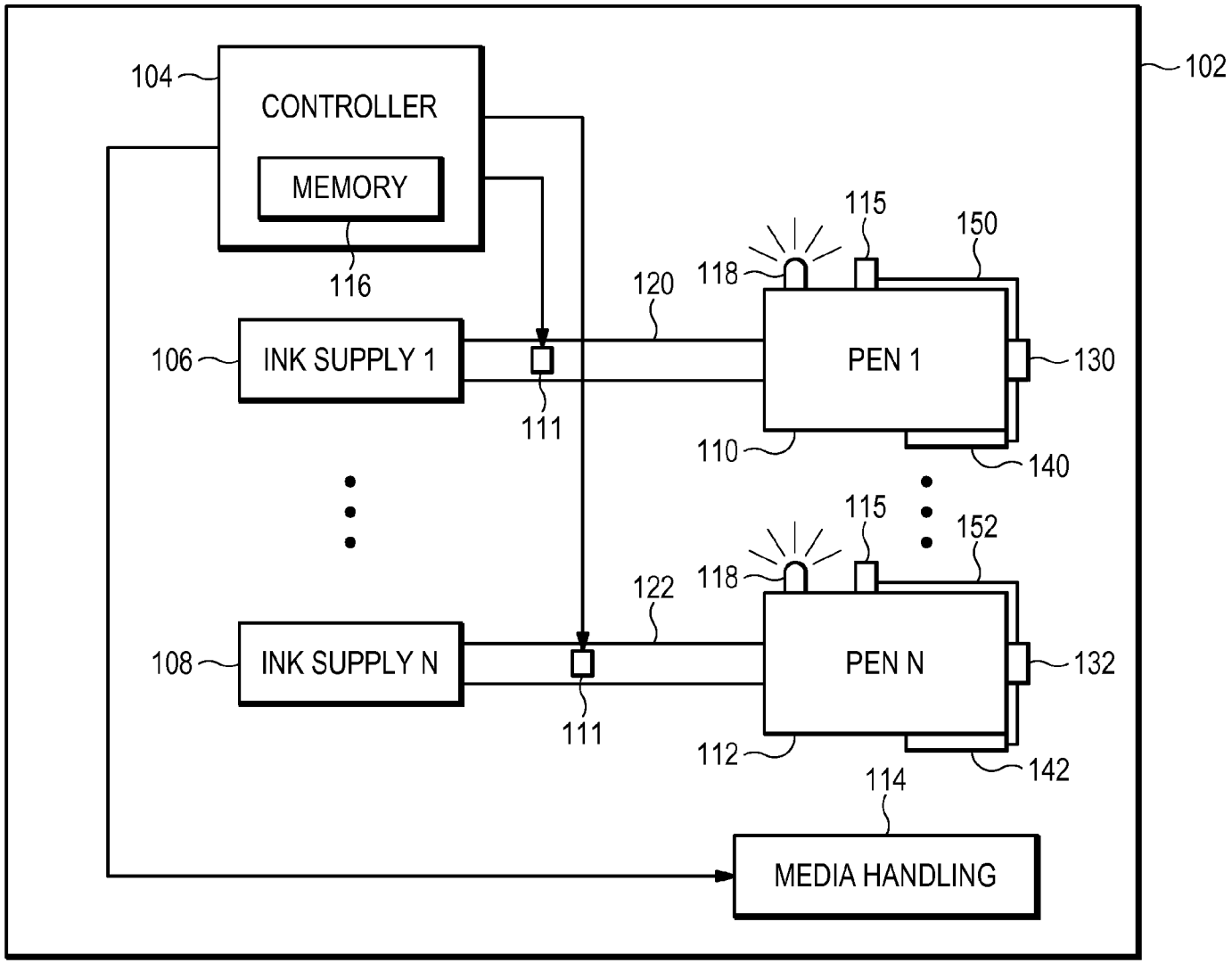
FIG. 1 is a diagram of a printing system according to an example embodiment.

As used in the present specification and in the appended claims, the term "inkjet pen" refers broadly to a container or device configured to selectively eject a liquid, such as ink. In some embodiments, the inkjet pen deposits ink onto a print medium in accordance with control signals received by the inkjet pen. In other embodiments, the inkjet pen may be configured to eject a liquid other than ink.

Inkjet pens may comprise a variety of different components to actuate the controlled deposition of ink drops. For example, inkjet pens may include, but are not limited to, piezo-electric inkjet pens, thermal inkjet pens, and others.

As used herein, the term "container" refers to an apparatus configured to hold a liquid, such as ink, regardless of whether the apparatus includes a printhead. Examples of containers include inkjet pens, ink supplies, and the like.

As used in the present specification and in the appended claims, the term "optical energy" refers to radiated energy having a wavelength generally between 10 nanometers and 500 microns. Optical energy as thus defined includes, but is not limited to, ultraviolet, visible, and infrared light. A beam of optical energy may be referred to herein as a "light beam" or "optical beam" or "light".

As used in the present specification and in the appended claims, the term "optical source" refers to a device from which optical energy originates. Examples of optical sources as thus defined include, but are not limited to, light emitting diodes, lasers, light bulbs, and lamps.

As used in the present specification and in the appended claims, the term "optical transmitter" refers broadly to a device configured to transmit data, such as digital bits or analog signals, using one or more optical sources. In some cases, optical transmitters as thus defined modulate the data onto light beams originating from the optical source(s) by varying specific characteristics of the light beams, such as beam intensity, wavelength, or duration of beam pulse.

Inkjet pens are generally used in printing devices, such as printers, copiers, and the like, to selectively deposit ink onto a print medium according to control data received. However, it may be desirable to reduce the number of physical components present in the printing system that are used to transport data and ink to the inkjet pen. Particularly, it may be desirable to provide an ink transportation system having integrated data transmission capabilities. A reduced number of components may lower the cost of fabricating the printing device and free up space within the printing device.

In accordance with some embodiments, a printing device may include diagnostic system components designed to aid service personnel in identifying faulty components. Optical indicators such as illuminated optical indicators may be used to indicate faulty inkjet pens. If internal systems determine that a particular inkjet pen is malfunctioning, light may be transmitted to light the optical indicator disposed on or associated with that inkjet pen.

While this arrangement may be helpful in identifying which pen to service or to otherwise indicate a pen status, it is also beneficial to provide a system of displaying an optical service indicator on specific inkjet pens without the presence of discrete LEDs and their associated space on the pens. Furthermore, it may also be desirable to reduce electromagnetic interference concerns, electrostatic discharge concerns, and concerns associated with differential ground shifts between electronics at each on opposite ends of an ink tube.

Consequently, the present specification discloses systems of ink and multi-channel data delivery in which data is transmitted optically over one or more channels to an inkjet pen through an optically conductive tubular body. The same tubular body may also serve to provide a flow of ink to the inkjet pen. Moreover, in accordance with some embodiments, one or more optical receivers are provided at the pen. As used herein, an "optical receiver" is a device configured to receive an optical signal and convert the optical signal to an associated electrical signal. Some optical receivers are configured to receive and process light in a particular range of wavelength, such as through the use of one or more filters.

Additionally, the present specification discloses embodiments of visual diagnostic indicators for inkjet pens. The system includes a tubular body having first and second ends. An optical source, or optical transmitter, is in optical communication with one of the ends, and the other end is in optical communication with a visual indicator or optical illuminator on the inkjet pen. Light from the optical source is transmitted through the tubular body and lights the visual indicator on the inkjet pen when needed to indicate, for example, a detected malfunction in that particular inkjet pen. The tubular body, in some embodiments, may be an ink conduit, such as a tube.

According to other embodiments, an inkjet pen is provided that includes a housing having an interface for receiving fluid and optical signals. A printhead is in fluid communication with the interface and a memory is electrically coupled to the printhead. An optical receiver is positioned at the housing and is in optical communication with the interface. The optical receiver is configured to convert received optical signals to electrical signals and to electrically pass the electrical signals to at least one of the printhead and the memory.

Pursuant to other embodiments, an optical indicator is positioned on an apparatus into which the pen is secured within the printing device. In some embodiments, this apparatus may be referred to as a "pen stall" or a "carriage". In these embodiments, a light pipe may be provided between an ink tube and the optical indicator to conduct light from the ink tube to the optical indicator.

FIG. 1 illustrates a printing system (102) including a controller (104), ink supplies (106, 108), inkjet pens (110, 112), and a media handling system (114). The ink supplies (106, 108) are shown as being fluidly connected with respective pens (110, 112) via fluid conduits (120, 122). Specifically, ink is delivered from the ink supply (106) through the conduit (120) to the pen (110). Likewise, ink is delivered from the ink supply (108) through the conduit (122) to the pen (112).

FIG. 1 illustrates a pair of ink supplies (106, 108) and a pair of pens (110, 112). In other embodiments a greater number of ink supplies, fluid conduits, and pens may be employed. Indeed, pursuant to other embodiments, separate ink supplies and associated pens may be provided for each of various colors, fixing fluids, and the like.

The controller (104) includes a memory (116) that includes firmware configured to control operation of the system (102). In general, during operation, the controller (104) provides control signals to the media handling system (114) to advance media (not shown), such as paper, adjacent the pens (110, 112). The controller (104) also provides control signals to the pens (110, 112) to cause the pens (110, 112) to eject ink onto the media.

In some embodiments, the controller (104) communicates with the pens (110, 112) via the respective conduits (120, 122). Specifically, optical transmitters (111) are positioned in or adjacent the conduits (120, 122). Corresponding optical receivers (115) are positioned at the pens (110, 114). The controller (104) sends control signals to the optical transmitters (111) which, in turn, generate associated optical signals and transmit the optical signals over the conduits (120, 122) to optical receivers (115) at respective pens (110, 112). The optical receivers (115) convert received optical signals into electrical signals. These electrical signals are provided to pen electronics via electrical conduits (150, 152). The pen electronics may include, for example, one or more of a memory (130, 132) and a printhead (140, 142)

It should be noted that in some embodiments, the optical transmitters (111) are configured as optical sources.

The conduits (120, 122) may be fabricated from a flexible material having optical properties that enable the transmission of light through the material of the sidewall of the conduits (120, 122) without significant loss of energy. Upon entering this material that composes the conduits (120, 122), the index of refraction of the material is such that, in some embodiments, substantially total internal reflection of the beam occurs, thus enabling the transmission of the optical beam along the length of the conduits (120, 122) with minimal losses. In other embodiments, the conduits (120, 122) may be lossy for certain types of signaling, given the relatively short distances of transmission. Even if the amplitude of the transmitted optical signal is significantly reduced when it reaches the optical receiver (115), as long as the receiver can detect the signal, the output of the receiver (115) may be amplified to the appropriate level.

Because transmitted optical beams are confined within the material of the conduits (120, 122), the conduits (120, 122) may be flexed or positioned according to the physical and spatial characteristics of the system (102). A linear or "line of sight" configuration between the optical transmitters (111) and the associated optical receiver (115) is not needed to ensure data transmission. Additionally, concerns stemming from electromagnetic interference, electrostatic discharge, and differential ground shifts between electronics at each end of the conduits (120, 122) are reduced or eliminated by transmitting data optically through the conduits (120, 122), as opposed to electrically.

An ink pump (FIG. 2) may be provided for each of the conduits (120, 122) to mechanically force liquid ink from an ink supply (106, 108) into the conduits (120, 122) where the ink is provided under pressure to the pens (110, 112). Each ink pump may be provided inside of or external to an associated one of the ink supplies (106, 108). In other embodiments, the ink supplies are otherwise pressurized to provide pressurized ink through the conduits (120, 122) to the pens (110, 112).

The conduits (120, 122) are configured to transmit or conduct one or more data channels. Multiple data channels may be transmitted together as distinct beams of optical energy, each of the beams having a characteristic wavelength that is separate and distinct from the characteristic wavelengths of other optical beams that are transmitted in the conduits (120, 122). Each of the separate optical beams may be modulated with different data. In some embodiments, the multiple channels of data transmitted through the conduits (120, 122) may be used for the purpose of increasing bandwidth or data integrity, with each of the data channels intended for the same destination. In other embodiments, separate data channels may be intended for separate destinations, such as different inkjet pens, using a same optical transmission medium in the conduits (120, 122).

The optical transmitters (111) are configured to transmit one or more channels of optical data into the conduits (120, 122) which conduct the optical data along its length to at least one of the optical receivers (115). In some embodiments, the optical transmitters (111) are ring-shaped structures having substantially the same cross-sectional shape and size as the conduits (120, 122). The optical transmitters may each include one or more optical sources, such as LEDs, vertical cavity surface emitting lasers (VCSELs), other lasers, from which the optical beams bearing the data originate.

In some embodiments, the optical transmitters (111) may include a plurality of optical sources, each source being configured to transmit an optical beam of a different characteristic wavelength. By transmitting data from each of the optical sources through the conduits (120, 122), multiple channels of data may be transmitted through the conduits (120, 122). In other embodiments, the optical transmitter (111) may include one or more optical sources that are configured to selectively alter the characteristic wavelength of optical beams originating from the sources, thus allowing the sources to transmit optical energy at one characteristic wavelength at a given time, and switch to a separate characteristic wavelength at another time.

The optical transmitters (111) are in communication with modulator elements (not shown) configured to encode digital or analog data onto the one or more optical beams emitted by the optical source(s). The modulator elements are configured to provide control signals to the optical transmitters (111) that affects the emission of the one or more optical beams by the optical transmitters (111) in addition to the characteristics of the beam(s). These modulator elements may encode data onto the beam(s) by selectively altering a property of the optical beams according to the data to be encoded. For example, the intensity, duration, and/or frequency of the optical beams may be dynamically altered by the modulator elements to encode data into the optical beam.

The optical receivers (115) at the pens (110, 112) are configured to receive one or more channels of optical data from the conduits (120, 122). In some embodiments, each of the optical receivers (115) includes at least one sensor configured to detect optical energy transmitted through the conduits (120, 122). In some embodiments, an optical receiver (115) may include a plurality of optical sensors, with individual sensors being configured to detect optical energy having a specific characteristic wavelength or ranges of wavelengths. In other embodiments, the optical receiver may have one or more optical sensors or detectors that are configured to receive optical beams of different wavelengths at different times.

The sensors in the optical receivers (115) are configured to output electronic signals representative of the data transmitted in the received optical beams, or optical signals, received through the conduits (120, 122). Examples of suitable optical sensors that may be included in the optical receiver include photodiodes, light-sensitive semiconductors, and photodetectors. An optical sensor may be tuned to detect a certain wavelength or range of wavelengths of light using filtering techniques. In this way, multiple optical beams having different characteristic wavelengths may be transmitted together through the conduits (120, 122) and separately detected by the optical receivers (115).

The optical receivers (115) may be in communication with or include demodulator elements (not shown) that are configured to extract the encoded data from the electrical signal output by the detectors in the optical receivers (115). In some embodiments, separate channels of data may be extracted from separate optical beams by the demodulator elements. In other embodiments, multiple modulator elements may be used in conjunction with corresponding multiple demodulator elements to transmit the data across the conduits (120, 122).

In the system (102) shown, pen control signals are produced by printer controller (104) to control the operation of the inkjet pens (110, 112). These pen control signals may be in the form of digital or analog data that is then encoded onto one or more optical beams using modulator elements and the optical transmitters (111). The pen control signals are then transmitted optically from the optical transmitters (111) along the conduits (120, 122) to the optical receivers (115). At the optical receivers (115) these signals are demodulated. The pen control signals are then received by the pen electronic components, such as memory (130, 132) and/or printhead (140, 142), where these signals are used to control pen operations.

In addition to the transmission of data to the inkjet pens (110, 112), the conduits (120, 122) may also be used by the pen electronics to send data to the printer controller (104). This data may include information such as pen health, pen type installed, pen temperature, etc. Data transmission from pens (110, 112) to the controller (104) may co-exist with data transmission from controller (104) to the pens. In these embodiments, the optical receivers (115) also are configured as optical transmitters and the conduits (120, 122) comprise channels for bi-directional optical communications between the pens (110, 112)

In still other embodiments, the conduits (120, 122) may be used by the controller (104) and an ink delivery system to communication with each other, possible concurrently. For example, the controller (104) may send data to the ink delivery system instructing the system to increase pressure, prime tubes, illuminate diagnostics LED, etc. The ink delivery system may transmit data to the controller (104), such as types of supplies installed, ink level remaining, diagnostic info, and/or other pertinent data.

The pens (110, 112) in FIG. 1 are also shown as including optical indicators (118). Optical energy passes from optical sources of the transmitters (111), through the conduits (120, 122), to the optical indicators (118) to illuminate a selected one or ones of the optical indicators (118). In some embodiments, an internal light pipe (not shown in FIG. 1) positioned at least partially within or on the pen (110, 112) routes optical energy from the conduits (120, 122) to an associated optical indicator (118). In other embodiments, the conduits (120, 122) are positioned such that an ends of the conduits (120, 122) connected to the pens (110, 112) are adjacent the associated optical indicators (118) such that optical energy passes directly from the conduits (120, 122) to the optical indicators (118) without use of a light pipe. Hence, in some embodiments, the optical indicators (118) are illuminated by optical energy transmitted by one of the optical transmitters (111).

The controller (104) may also be configured to include diagnostic circuitry and/or firmware to selectively activate at least one optical indicator (118) according to output of the diagnostic circuitry. For example, the diagnostic circuitry may receive data from at least one sensor (not shown) in the system (102) representative of the health of a particular pen (110, 112). When a pen (110, 112) is performing poorly or experiences a malfunction, the controller (104) may then selectively illuminate an optical indicator (118) at the particular pen using the optical source (111 ) associated with the pen. This may permit service personnel to quickly identify the pen at issue.

In these embodiments, an interface is configured to route at least a portion of the optical beam received from the conduit (120, 122) to the optical indicator (115). The optical indicator (115) may include a transparent or translucent material that allows light from the conduit (120, 122) to shine through the indicator (115) so as to be seen from outside of the associated inkjet pen (110, 112). The indicator (115) may be at a readily-visible location on the inkjet pen (110, 112) and is then illuminated by the optical beam from the source (111).

Transmitting data to the pen optically, rather than electrically, may be beneficial in that a reduced pinout may be employed, thereby reducing cost and complexity. Moreover, transmitting data in this manner may increase security. Indeed, the optical signals may be transmitted in an encoded fashion.

In some embodiments a serial number, or other code, is associated with a particular pen. The optical sources (111) may then transmit data using this serial number as part of the encoding scheme, such that this code is used at the pen to decode transmitted signals.

Figure 2:
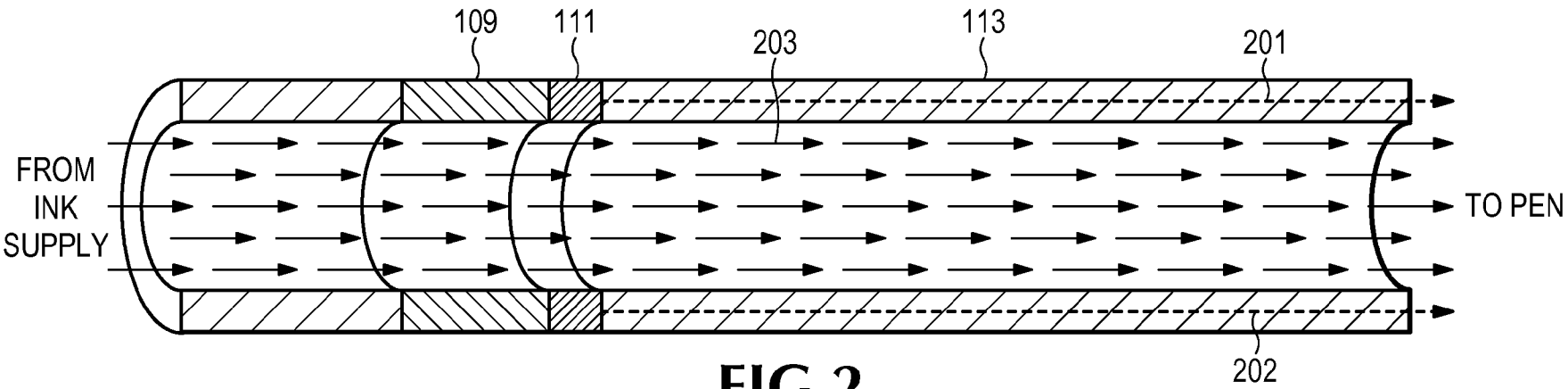
FIG. 2 is a cross-sectional diagram of an example embodiment of a tubular body for ink and data delivery.

FIG. 2 illustrates a cross-sectional view of a tubular body (113), which may comprise one of the conduits (120, 122) shown in FIG. 1. Illustrative paths (201, 202) of optical energy through the material of the walls of the tubular body (113) are shown as dotted lines going from the optical transmitter (111) to the associated pen (not shown). While optical energy may undergo numerous internal reflections within the material of the tubular body (113) between the optical transmitter (111) and the pen, the illustrative paths (201, 202) are shown as straight for clarity and ease of illustration. The tubular body (113) may lie along a curved path within the system (102).

Additionally, an ink pump (109) includes further mechanical components to propel the ink from the ink supply into the tubular body (113). These components have also been removed for clarity, but are readily understood and available in the art. An illustrative ink path is indicated by the solid arrows (203).

The tubular body (113) is shown here to be straight. However, it will be understood that the tubular body (113) may be flexed or manipulated to follow a nonlinear path as needed to accommodate other components within the interior of a printing device.

Figure 3:
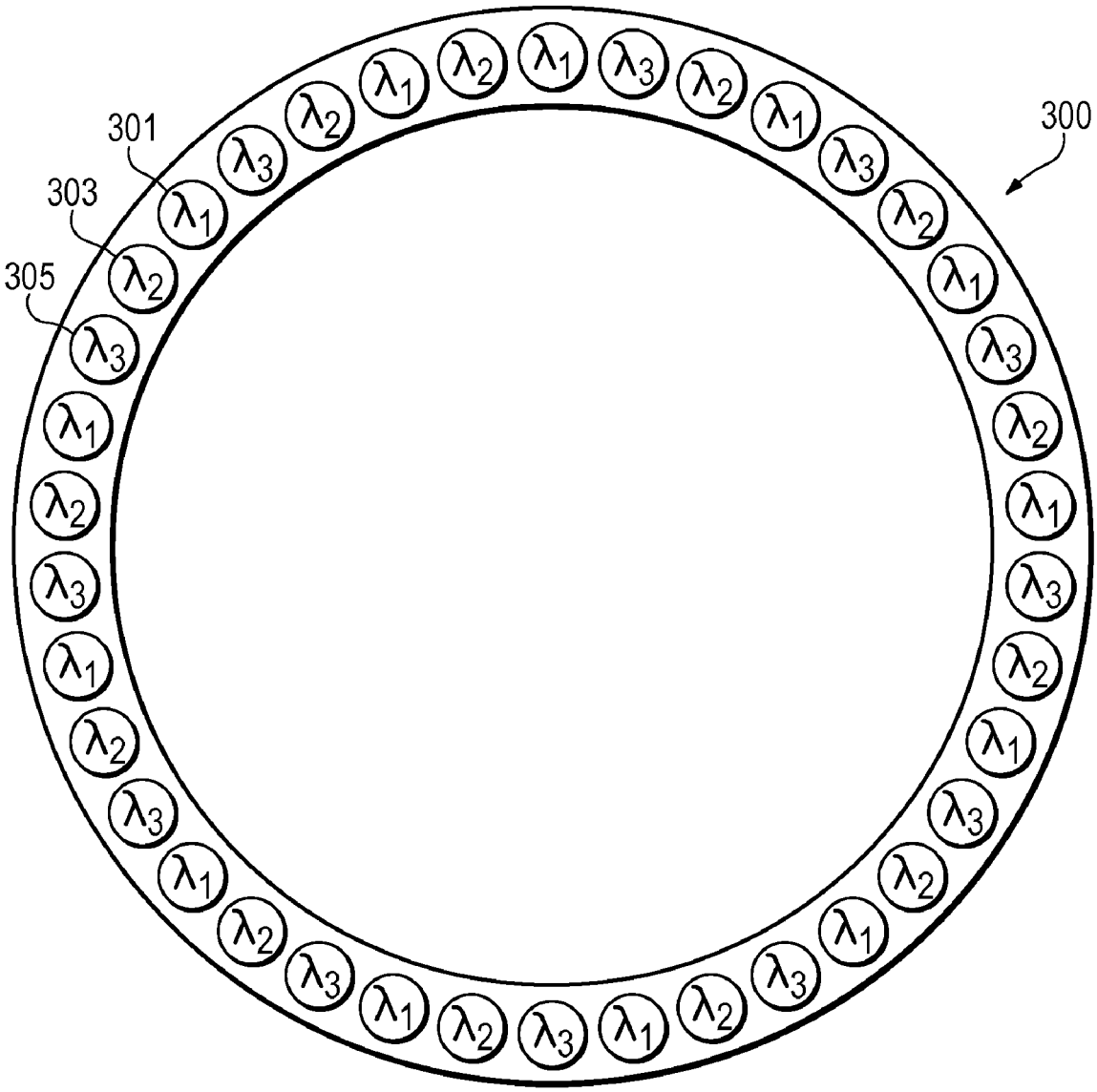
FIG. 3 is a diagram of an example embodiment of an optical transmitter.

Referring now to FIG. 3, a diagram of an illustrative embodiment of an optical transmitter (300) is shown. The optical transmitter (300) may be used in conjunction with a tubular body (113, FIG. 2) to transmit data optically through the tubular body (113, FIG. 2) to a corresponding receiver. The optical transmitter (300) has a ring shape with substantially the same cross-sectional area as the tubular body (113, FIG. 2). The optical transmitter (300) includes a plurality of optical sources (301, 303, 305) configured to transmit modulated optical beams directly into the material of the tubular body (113, FIG. 1). Each of the optical sources (301, 303, 305) is configured to transmit optical beams having a specific characteristic wavelength (for example, $\lambda_1$, $\lambda_2$, $\lambda_3$, respectively). Each of the wavelengths (($\lambda_1$, $\lambda_2$, $\lambda_3$) of optical energy may carry a separate channel of data to be transmitted to the optical receiver. In the present example, multiple optical sources (301, 303, 305) are disposed circumferentially about the body and regularly alternate among three different types of optical sources (301, 303, 305) each configured to respectively transmit one of the three indicated wavelengths ($\lambda_1$, $\lambda_2$, $\lambda_3$).

An optical source control line from the modulator element (119) corresponding to the first wavelength ($\lambda_1$) may be in communication with each of the optical sources (301) configured to transmit at the first wavelength ($\lambda_1$). In this way, all of the optical sources (301) configured to transmit optical energy at the first wavelength ($\lambda_1$) may transmit substantially equivalent modulated optical beams concurrently. Similarly, optical sources (303) configured to transmit at the second wavelength ($\lambda_2$) may transmit substantially equivalent modulated optical beams concurrently, and the optical sources (305) configured to transmit at the third wavelength ($\lambda_3$) may also transmit substantially equivalent modulated optical beams concurrently.

Figure 4:
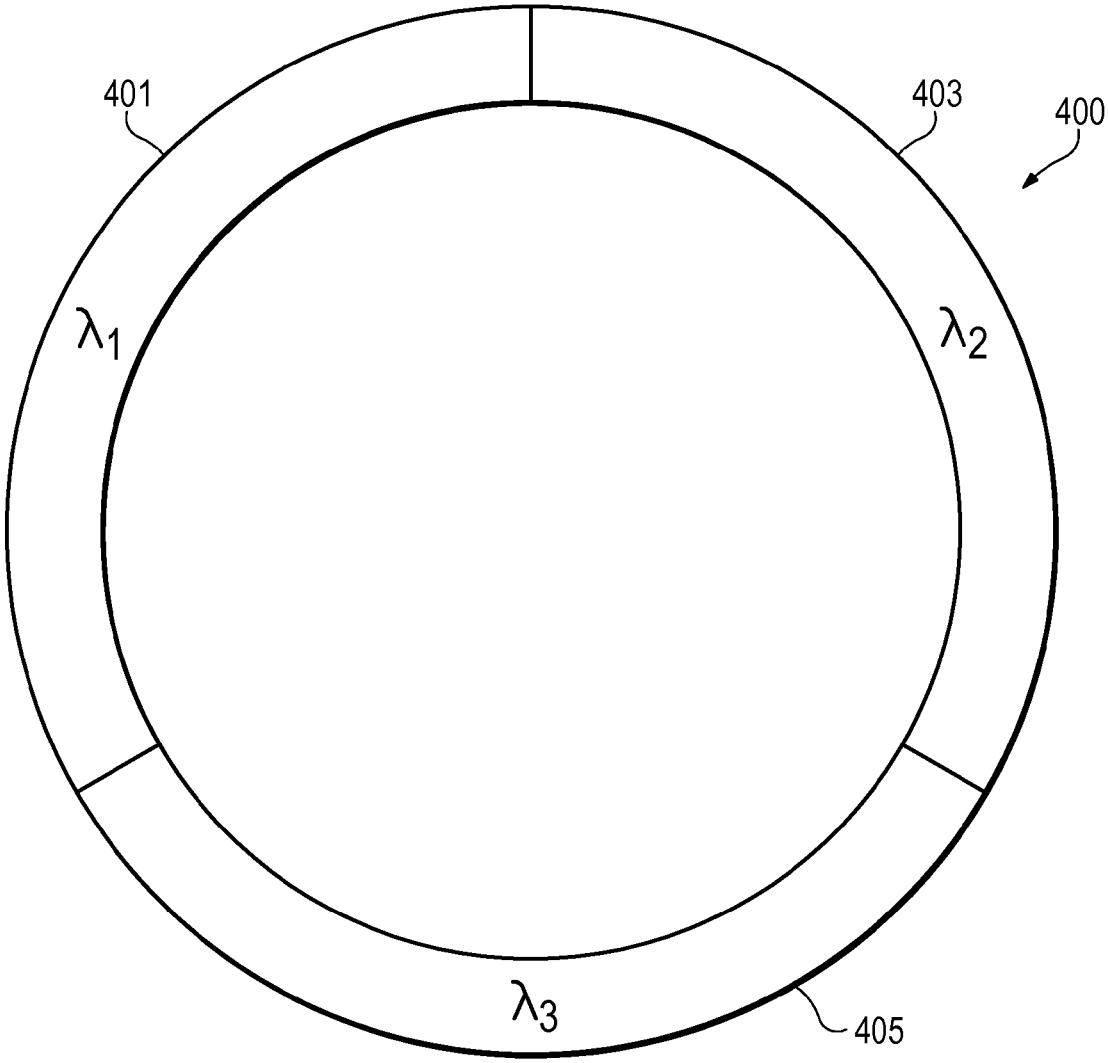
FIG. 4 is a diagram of another example embodiment of an optical transmitter.

Referring now to FIG. 4, another illustrative embodiment of a possible optical transmitter (400) is shown. The optical transmitter (400) includes three separate optical sources (401, 403, 405). Each of the optical sources (401, 403, 405) is configured to transmit a modulated optical beam into the tubular body (113, FIG. 2) having a specific characteristic wavelength ($\lambda_1$, $\lambda_2$, $\lambda_3$, respectively).

As will be appreciated by those skilled in the art, while three types of transmitters outputting three different respective wavelengths are shown in the examples of FIGS. 3 and 4, any number of different wavelengths and corresponding transmitters may be used depending on the number of data channels desired. Moreover, different data channels may be differentiated by means other than distinct wavelength. For example, different data channels may be differentiated by beams of different intensity, polarization, etc.

Figure 5:
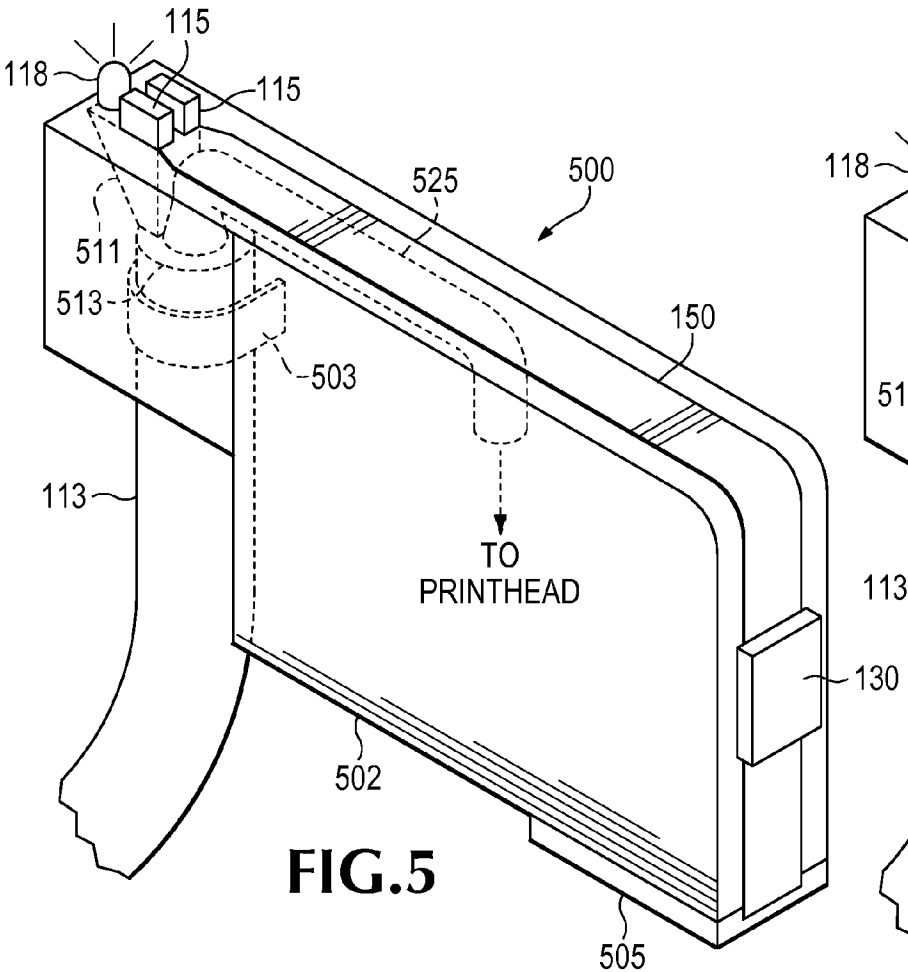
FIG. 5 is a diagram of an inkjet pen in accordance with an example embodiment.

Referring to FIG. 5, an illustrative example embodiment of an inkjet pen (500) is shown. As shown, the pen (500) includes body (502) that functions as a container for storing a fluid, such as ink delivered from the tubular body (113). The tubular body (113) shown in FIG. 2 and described above may comprise one or more of the conduits (120, 122) shown in FIG. 1 and may be secured to the pen (500) with band (503) or other suitable structure. The pen (500) is generally configured to eject a liquid, such as ink through printhead (505).

The pen (500) is shown as including optical receivers (115) at the pen (500). The optical receivers (115) are illustrated as being disposed on an external surface of the pen body (502). In other embodiments, the optical receivers (115) may be positioned within or internal the pen body (502). In this embodiment, a light pipe (511) is positioned between an end (513) of the tubular body (113) and the optical receivers (115). The light pipe (511) conducts light or optical energy between the end (513) of the tubular body (113) and the optical receivers (115).

The optical receivers (115) are electrically coupled to a memory (130) and a printhead (140) via electric coupling 150. In some embodiments, the electric coupling (150) may comprise a flex circuit, a printed circuit assembly, wires, or the like. In this configuration, electronic signals may be transferred between the memory (130), the printhead (140), and the optical receivers (115) via the electric coupling (150).

An optical indicator (118) is shown at the pen body (502). In the embodiment shown in FIG. 5, the optical indicator (118) is on an external surface of the pen body (502) and is optically coupled to the tubular body (113) via the light pipe (511). The optical indicator (118), in some embodiments, provides visual feedback. For example, illumination of the optical indicator (118) on a pen (500) may indicate whether the particular pen (500) is functioning properly or may indicate some other status of a component of the system (102). Moreover, the optical indicator (118) may be selectively illuminated with light of different colors to indicate different statuses of the associated pen (500). That is, illuminating the optical indicator (118) with light of one color might indicate one status, whereas illuminating the optical indicator (118) with light of another color might indicate another status.

A liquid conduit (525) interfaces with a generally center portion of the tubular body (113) to receive ink, or other liquid, from the tubular body (113) and to conduct the received ink towards the printhead (505). In some embodiments, other structures (not shown), including one or more reservoirs, are disposed between the liquid conduit (525) and the printhead (505) to aid in supplying ink to the printhead (505).

Figure 6:
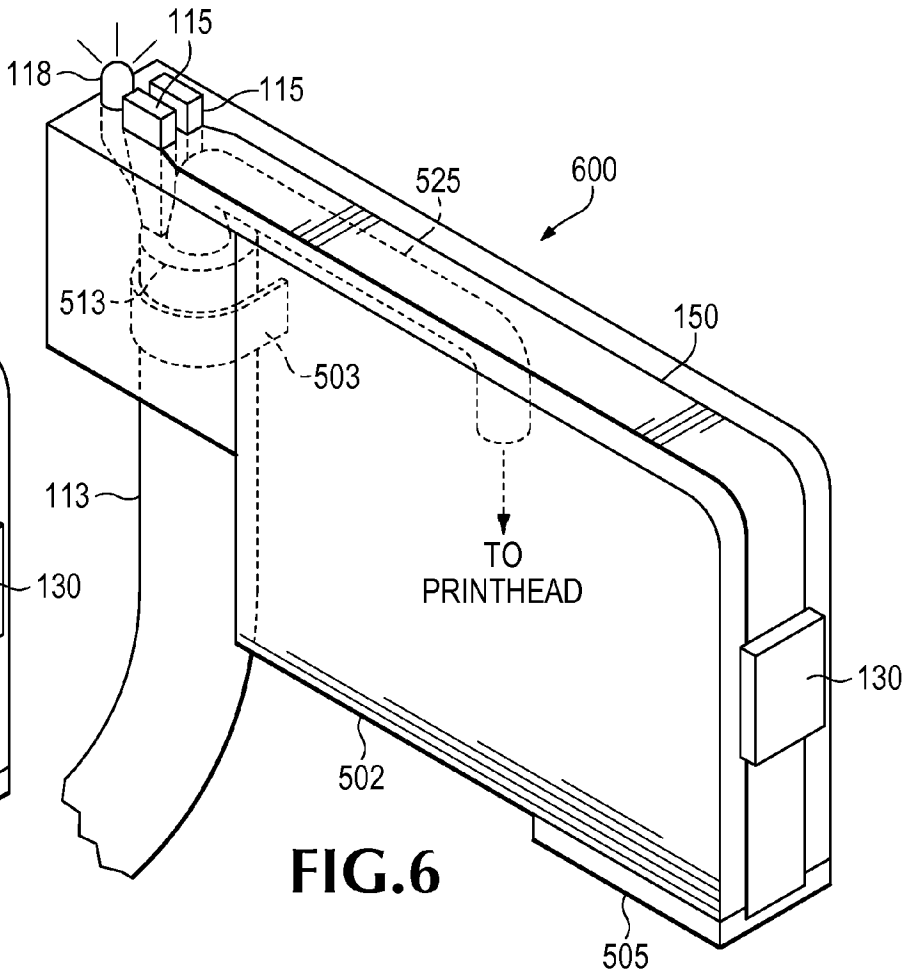
FIG. 6 is a diagram of another inkjet pen in accordance with an example embodiment.

Referring now to FIG. 6, an example pen (600) is illustrated. The pen (600) is similar to the pen (500) of FIG. 5, except as follows. The optical indicator (118) and the optical receivers (115) are in direct optical communication with the tubular body (113). In this embodiment, therefore, a light pipe is not positioned between the end (513) of tubular body (113) and the optical indicator (118) and the optical receivers (115). Thus, optical signals or optical energy passes directly from the tubular body (113) to the optical indicator (118) and the optical receivers (115).

The tubular body (113) may be fabricated from a flexible material having optical properties that enable the transmission of light with no significant loss of energy. Upon entering this material that composes the tubular body (113), the index of refraction of the material is such that substantially total internal reflection of the beam occurs, thus enabling the transmission of the optical beam along the length of the tubular body (113) with minimal losses. Many plastic materials having such optical properties are available in the art. Additionally, custom plastics or other materials having desirable optical characteristics for use in the tubular body (113) may be used in some embodiments. Indexes of refraction between the end (513) of the tubular body (113) and the optical indicator (118) and the optical receivers (115) may be configured to permit a suitable amount of optical energy to pass between the tubular body (113) and the optical indicator (118) and the optical receivers (115).

Figure 7:
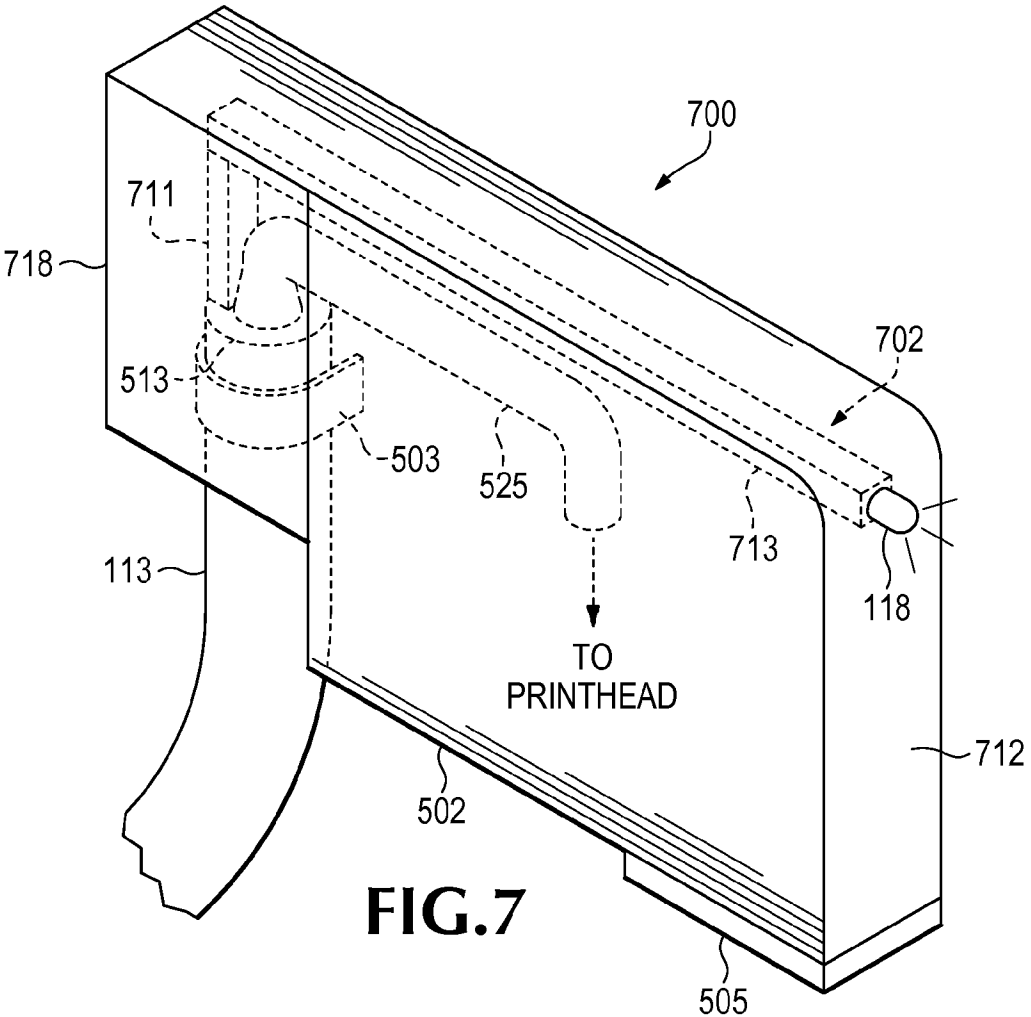
FIG. 7 is a diagram of another inkjet pen in accordance with an example embodiment.

FIG. 7 illustrates an example embodiment of a pen (700), which is similar to pen (600), except as follows. The pen (700) does not include optical receivers and includes an internal light pipe (702) that extends from the end (513) of the tubular body (113) to the optical indicator (118). The light pipe (702) is shown as having sections (711) and (713). In other embodiments, however, the light pipe (702) is a single, integral member. The light pipe (702) conducts optical energy from the end (513) of the tubular body (113) to optical indicator (118). In this embodiment, the optical indicator (118) is on a side (712) of the pen (700) opposite the pen interface (718).

Figure 8:
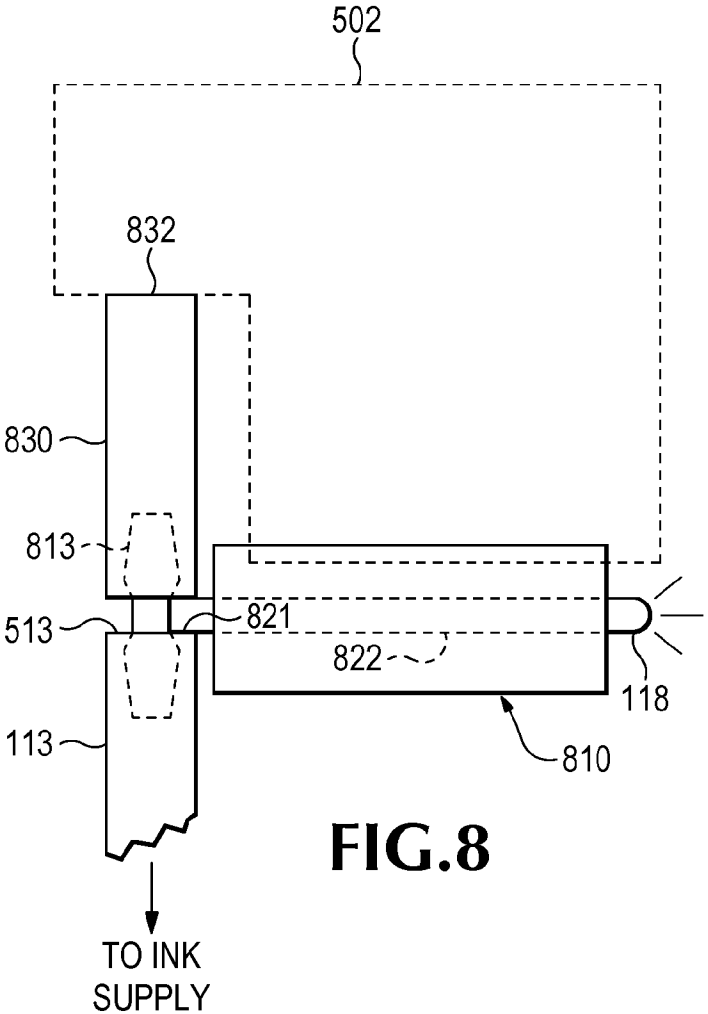
FIG. 8 is a diagram of a carriage for an inkjet pen in accordance with an example embodiment.

FIG. 8 illustrates a carriage (810) having an optical indicator (118) thereon. As used herein, "carriage" refers to the structure into which or on which a pen may be mounted or otherwise secured. The carriage may be movable or stationary during printing, depending upon the configuration of the system. In some embodiments, the carriage may be referred to as a "pen stall." In this embodiment, ink and optical energy are delivered via the tubular body (113). At the end (513) of the tubular body (113) a light pipe (822) is provided that conducts optical energy from the tubular body (113) to the optical indicator (118) positioned at the carriage 810. Hence, optical energy passes through the tubular body (113), then through the light pipe (822) to the optical indicator (118). The end (821) of the light pipe (822) is in optical communication with the end (513) of the tubular body (113). In some embodiments, the end (821) of the light pipe (822) and the end (513) of the tubular body (113) have indexes of refraction that are suitable to permit adequate optical energy to pass between the tubular body (113) and the light pipe (822) to illuminate the optical indicator (118).

A connector (813) is a hollow body that may be positioned at the end (513) of the tubular body (113) for conducting ink from the tubular body (113) towards the pen (502). The connector (813) may be useful in permitting the tubular body (113) to be separated from the ink interface (832) at the pen (502). In this embodiment, a conduit (830) is positioned between the connector (813) and the ink interface (832) to conduct ink from the tubular body (113) to the ink interface (832) at the pen (502).

The light pipe (822) may be positioned on the carriage (810). The light pipe (822) may be internal or external to the carriage (810) such that the light pipe (822) conducts optical energy from the tubular body (113) to the optical indicator (118) positioned on the carriage. Illumination of the optical indicator (118) may be used to indicate a status of one or more pens (502) positioned at the carriage (810).

Figure 9:
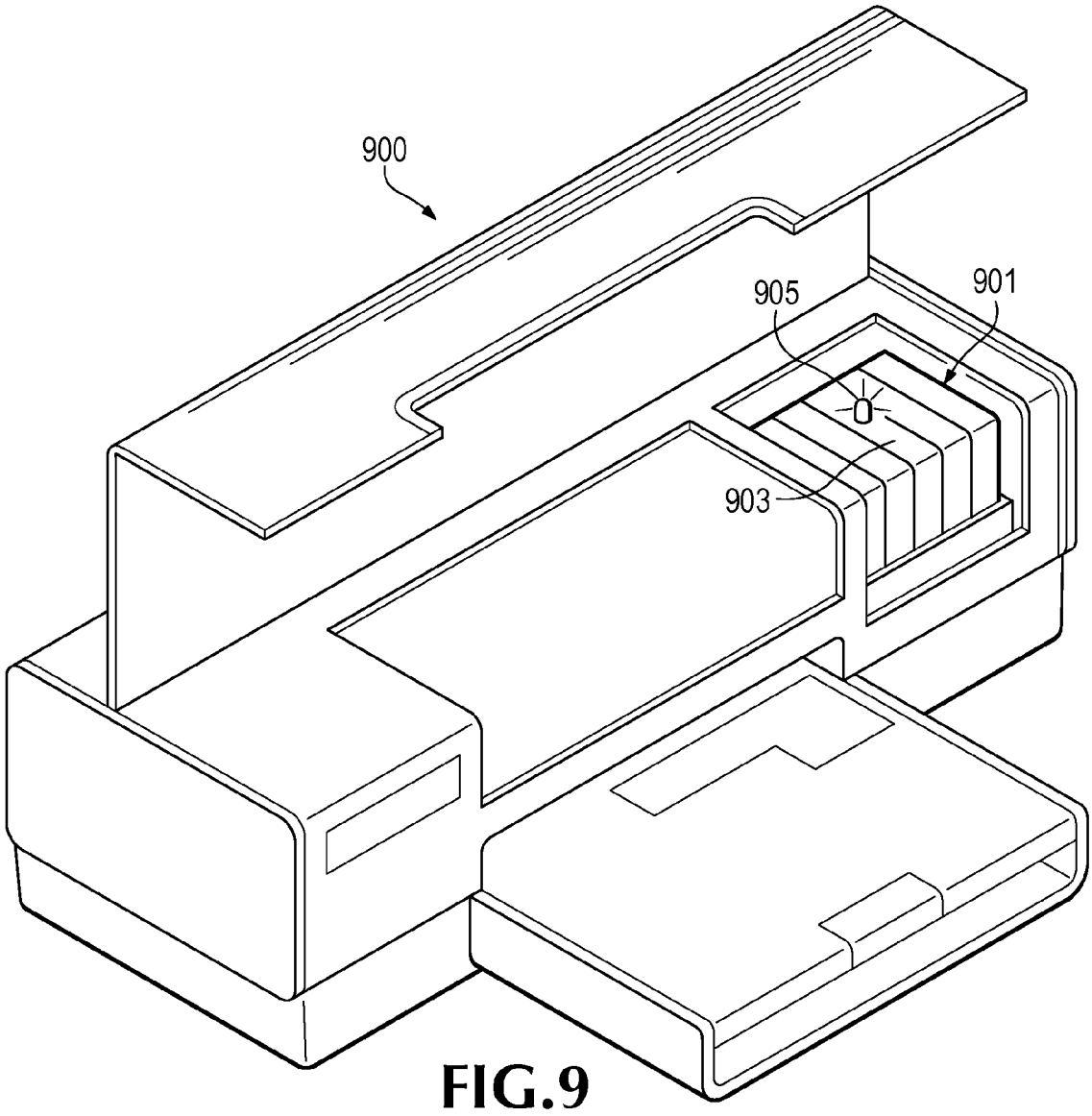
FIG. 9 is a diagram of an example embodiment of a printing device having an optical indicator.

Referring now to FIG. 9, an illustrative embodiment of a printing device (900) is shown. The printing device (900) is shown with a diagnostic visual indicator (905) illuminated in an inkjet pen (903). The inkjet pen (903) is one of a group of inkjet pens (901) present in the printing device (900). As mentioned previously, the illuminated visual indicator (905) may help service personnel identify the faulty inkjet pen quickly and efficiently.

Figure 10:
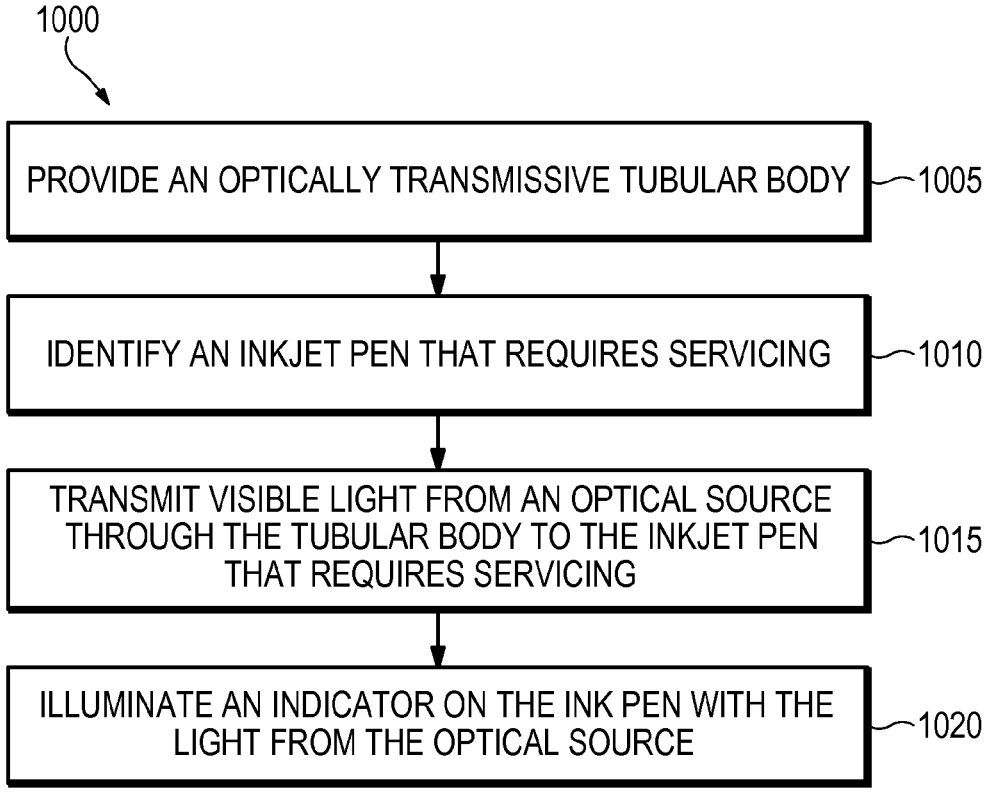
FIG. 10 is a flowchart of a method in accordance with an example embodiment.

Referring now to FIG. 10, a flowchart of an illustrative embodiment of a method (1000) of diagnostic indication in a printing device is shown. The method includes providing (1005) an optically transmissive tubular body between an ink supply and at least one inkjet pen in the printing device. The tubular body is fabricated from a material having sufficient optical properties to sustain total internal reflection of optical energy transmitted into the tubular body.

The method (1000) further includes identifying (1010) an inkjet pen in the printing device to be illuminated for identification for servicing. This may be done by evaluating sensor output in diagnostic circuitry. Visible light is then transmitted (1015) from an optical source through the tubular body to the inkjet pen that requires servicing. The optical source may have a substantially cylindrical geometry such that the cross-sectional geometries of the tubular body and the optical source may be coupled together and the visible light may be transmitted directly from the optical source into the material of the tubular body.

The visible light may be routed from the tubular body to an internal light pipe in the inkjet pen. A visual indicator on the inkjet pen is then illuminated (1020) with the visible light. The optical illuminator may include a transparent material that transmits the light exiting from the internal light pipe outside of the inkjet pen. Additionally, ink may be supplied through the tubular body from an off-axis reservoir to the same inkjet pen.

Figure 11:
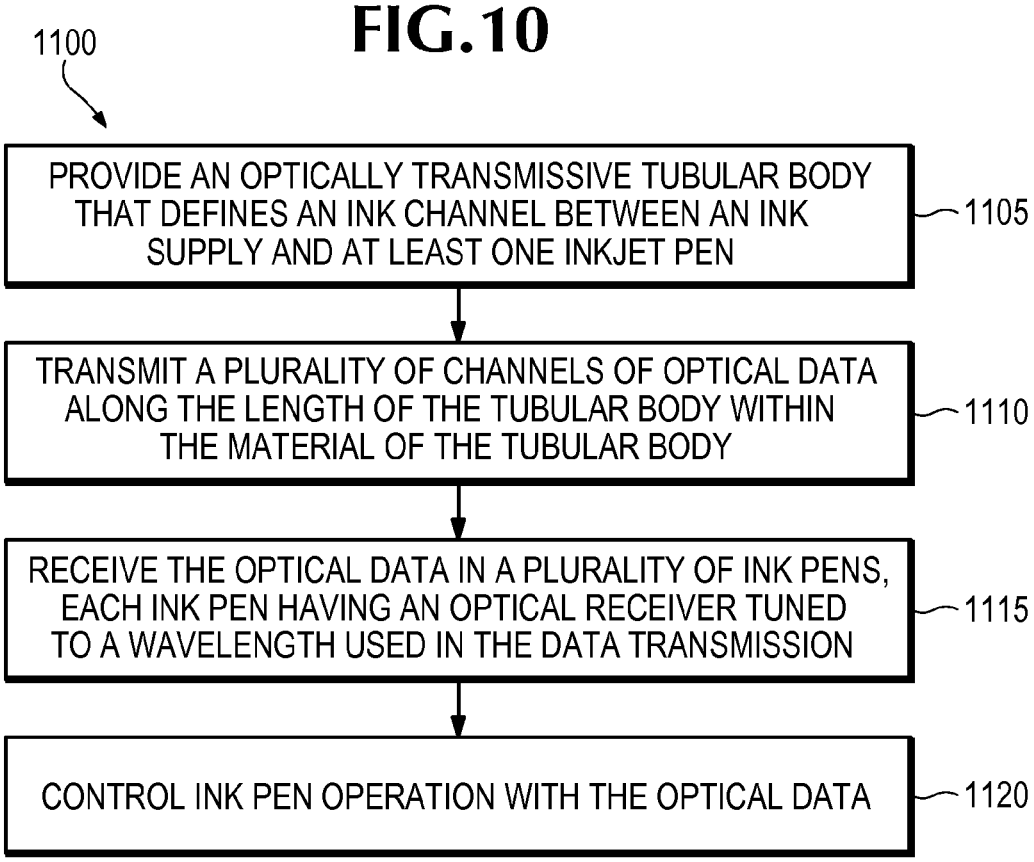
FIG. 11 is a flowchart of a method in accordance with an example embodiment.

Referring now to FIG. 11, a flowchart of an illustrative embodiment of a method (1100) of ink and multi-channel data delivery is shown. The method (1100) includes providing (1105) an optically transmissive tubular body that defines an ink channel between an ink supply and at least one inkjet pen. A plurality of channels of optical data are transmitted (1110) along the length of the tubular body within the material of the tubular body. The multiple channels may be transmitted over a plurality of wavelengths of optical energy from at least one optical transmitter at one end of the tubular body.

The optical data are then received (1115) in a plurality of inkjet pens, with each of the inkjet pens having an optical receiver tuned to a specific wavelength of optical energy used in the data transmission. Thus, in this example, each of the optical receivers is configured to receive a different channel of optical data from the tubular body. The operation of the inkjet pens is then controlled (1120) by the data received at the optical receivers corresponding to each of the inkjet pens.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A fluid container, comprising:

a body having an inlet configured to receive a fluid;

a printhead configured to eject the fluid received at the inlet;

an optical receiver at the body and positioned in optical communication with the inlet such that optical signals received at the inlet are received at the optical receiver.

2. The fluid container of claim 1, further comprising:

electrical coupling between the printhead and the optical receiver;

the optical receiver configured to convert the received optical signals into electrical signals and to transmit the electrical signals to the printhead via the electrical coupling.

3. The fluid container of claim 1, further comprising:

electrical coupling between the printhead and the optical receiver;

a memory electrically coupled to the printhead;

the optical receiver configured to convert the received optical signals into electrical signals and to transmit the electrical signals to the memory via the electrical coupling.

4. The fluid container of claim 1, further comprising an optical indicator exposed at an external surface of the body, the optical indicator in optical communication with the inlet.

5. The fluid container of claim 1, further comprising multiple optical receivers configured to receive optical signals of different wavelengths.

6. The fluid container of claim 1, wherein the inlet is configured to attach to an ink supply fluid conduit.

7. The fluid container of claim 6, further comprising an optical conductor between the inlet and the optical receiver, wherein the optical conductor transmits light received at the inlet to the optical receiver.

8. The fluid container of claim 7, wherein the optical conductor is a light pipe.

9. The fluid container of claim 1, wherein the optical receiver comprises an optical sensor operable to produce electrical signals from optical signals received at the inlet, and a demodulator operable to extract data encoded in electrical signals produced by the optical sensor.

10. A method, comprising:

providing a fluid container comprising a body having an inlet configured to receive a fluid, a printhead configured to eject the fluid received at the inlet, and an optical receiver at the body and positioned in optical communication with the inlet such that optical signals received at the inlet are received at the optical receiver;

supplying fluid to the body through the inlet; and transmitting optical signals to the optical receiver through the inlet.

* * * * *